US005424491A

United States Patent [19]

Walling et al.

[11] Patent Number: 5,424,491

[45] Date of Patent: Jun. 13, 1995

[54] TELECOMMUNICATIONS CABLE

[75] Inventors: Jorg-Hein Walling, Beaconsfield; Clement Gagnon, Pierrefonds; Paul P. Kish, St. Lazare; Martin L. Belanger, Montreal, all of Canada

[73] Assignee: Northern Telecom Limited, Montreal, Canada

[21] Appl. No.: 133,392

[22] Filed: Oct. 8, 1993

[51] Int. Cl.[6] ..... H01B 11/04

[52] U.S. Cl. ..... 174/113 R; 174/34

[58] Field of Search ..... 174/113 R, 34

[56] References Cited

U.S. PATENT DOCUMENTS

| | | | |
|---|---|---|---|
| 3,271,508 | 9/1966 | Burr | 174/34 |
| 3,489,844 | 1/1970 | Motley | 174/34 |
| 4,408,443 | 10/1983 | Brown et al. | 174/34 |
| 4,697,051 | 9/1987 | Beggs et al. | 174/34 |
| 4,873,393 | 10/1989 | Friesen et al. | 174/34 |
| 5,010,210 | 4/1991 | Sidi et al. | 174/34 |
| 5,162,609 | 11/1992 | Adriaenssens et al. | 174/34 |

FOREIGN PATENT DOCUMENTS

| | | | |
|---|---|---|---|
| 1265877 | 5/1961 | France | 174/34 |
| 197808 | 6/1978 | Germany | 174/34 |
| 1059343 | 2/1967 | United Kingdom | 174/34 |

*Primary Examiner*—Morris H. Nimmo
*Attorney, Agent, or Firm*—R. J. Austin

[57] ABSTRACT

High frequency cable with short twist lays with the insulation thickness of conductors being different from that of others, the thickness of insulation being dependent upon twist lay length so as to achieve a desired characteristic impedance and signal attenuation.

5 Claims, 1 Drawing Sheet

TELECOMMUNICATIONS CABLE

This invention relates to telecommunications cable.

In the telecommunications cable industry, specific designs of cable have conventionally been used for inside buildings. A conventional cable design, which has been employed for voice frequency ranges and low speed data, e.g., up to about 4 or 4.5 megabytes, is one in which the conductors are all of the same gauge and the conductors of each conductor pair are twisted together with a twist length, referred to as a "twist lay", of between 3.7 and 5.7 inches. While the above design of cable operates satisfactorily within the voice frequency range, it has been found to be unsatisfactory for various reasons above this range and has limitations for use with digital systems and local area networks using much higher frequencies. In particular, attenuation of signals at around 16 megabytes is undesirably high as is the amount of crosstalk experienced. For high frequency data transmission, e.g. up to about 100 megabytes, a conventional cable design for all voice frequency range use is entirely unsatisfactory.

In U.S. Pat. No. 5,010,210 to S. Sidi, et al and entitled "Telecommunications Cable", an unshielded telecommunications cable is described of special design in which it is recognized that the use of small twist lays for twisted conductor pairs in a particular cable provides the surprising result that electromagnetic interference is reduced to commercially acceptable levels even through the cable is unshielded, to provide minimization in crosstalk.

Capacitance in a conductor is dependent, in part, upon the length of the conductor. On the other hand, inductance is proportional to the "physical spacing area" between conductors that is the distance between the conductors taken along the lengths of the conductors. The nominal characteristic impedance of a twisted pair in telecommunications cable is commercially acceptable if it has a value of 100 ohms±15 ohms. With a cable designed for voice frequency range use, the twist lays in adjacent pairs are designed to be different from one another for the purpose of minimizing crosstalk. Although for a unitary length of cable, these twist lays differ, the nominal characteristic impedance for any one pair is easily controlled within the required limits, because any change in the normal large twist lays, e.g. between 3.70 and 6.00 inches, results in similar changes in the conductor length and in the physical spacing area between conductors, whereby changes in inductance and capacitance are substantially proportionate and the nominal characteristic impedance thus remains substantially unchanged. However, when a cable is provided with small twist lays to its twisted pairs and these twist lays differ from pair to pair so as to minimize crosstalk, the changes in twist lay from pair to pair are accompanied by large variations in the physical spacing area which provide large variations in inductance, but the helical lengths of the conductors from pair to pair vary more widely whereby change in capacitance is significantly larger than change in inductance. As a result, the nominal characteristic impedance is uncontrollable from pair to pair and it is found that in any cable there is a tendency for the nominal characteristic impedance of at least some pairs to be at or beyond the acceptable nominal characteristic impedance value in the telecommunications industry. Certainly for a cable having twenty-five pairs of twisted conductors, conventional cable design cannot provide an acceptable nominal characteristic impedance for each pair where all pairs have small, but different twist lays.

The present invention seeks to provide a telecommunications cable which minimizes or avoids the above problems.

Accordingly, the present invention provides a telecommunications cable comprising a core having a plurality of pairs of twisted together individually insulated conductors, the maximum twist lay length being 2.00 inches, the twist lay length of at least some conductor pairs being different from that of others, and the insulation thickness of the conductors of at least some pairs being different from that of other pairs with the conductors of each pair having a thickness of insulation which provides the pair with a characteristic impedance which is within desirable limits and an acceptable signal attenuation.

With the above structure of the invention the insulation thicknesses of the conductors are matched to the twist lay lengths so as to provide in each case a nominal characteristic impedance for each twisted pair which lies within the normal acceptable commercial range. In practice, and within the scope of the invention, the pairs of conductors with the smallest twist lays necessarily have thicker insulations on the conductors than the pairs of conductors with the largest twist lays. The increase in thickness of the insulation provides for a larger physical spacing area increase than could be obtained using thinner insulation so as to be comparable more closely to the necessary increase in the lengths of the conductors to provide the small twist lays. Accordingly, changes in inductance and capacitance from one twisted pair to another are more closely aligned whereby the impedance can be more closely controlled within acceptable limits.

In principle, the present invention includes a structure of cable in which the twist lay length of each pair is different from that of each other pair and also in which the conductor insulation thicknesses are different from one pair to another. In a practical sense having completely different thicknesses of insulation from pair to pair may be highly inconvenient, impractical and may be expensive. Accordingly, in a preferred cable structure, less thicknesses of insulation may be used than the number of twist lays in the twisted pairs. Conveniently, the same thickness of insulation may be used over a range of twist lay lengths while still providing a nominal characteristic impedance which is within the desirable limits, and another thickness of insulation may be used for a different range of twist lays to provide similar results. In particular, therefore, it is preferable for a first plurality of conductor pairs having twist lays within a first range and have the same conductor insulation thickness which is consistent with providing a nominal characteristic impedance for each conductor pair of the first plurality within desirable limits and an acceptable signal attenuation, and at least a second plurality of conductor pairs is provided and which have twist lays within a second range. The conductors of the second plurality of conductor pairs each has substantially the same conductor thickness which is different from that of the first plurality of pairs to provide a nominal characteristic impedance for each conductor pair of the second plurality which is within the desirable limits and also an acceptable signal attenuation.

The inventive concept may be used in telecommunication cables with different numbers of conductor pairs and in a particular case using twenty-five conductor pairs, a plurality of thicknesses of insulation may be employed to extend over different limits of twist lay lengths to provide the desired results. In a practical arrangement having twenty-five conductor pairs, it has been found that two insulation thicknesses may be provided, each insulation thickness applicable to an individual plurality of pairs of conductors lying within a certain range of twist lays while providing the acceptable nominal characteristic impedance and attenuation values.

The invention is applicable both to cables with and without a shield surrounding the core.

One embodiment of the invention will now be described, by way of example, with reference to the accompanying drawings, in which.

Figure 1:
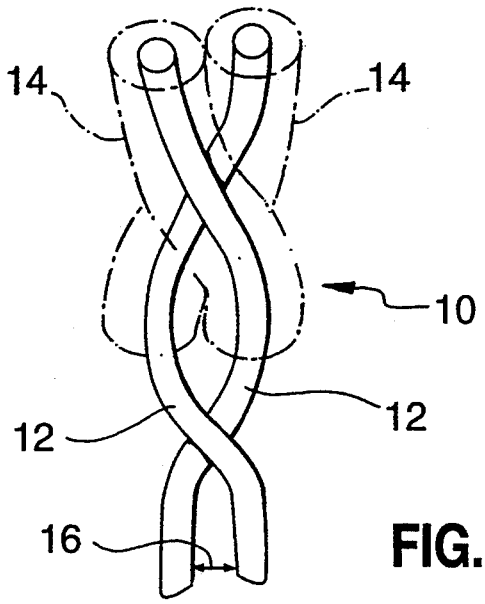
FIG. 1 is an isometric diagrammatic view of part of a conventional twisted pair of individually insulated conductors.

In telecommunication cable constructions, as shown by FIG. 1, pairs 10 of conductors are normally used, the pairs 10 comprising two individually insulated conductors 12 each having a layer of insulation 14 (chain-dotted) which maintains the conductors apart. Each pair of conductors is twisted to have a particular twist lay, that is the twist length produced between them, and the distance between the conductors is controlled by the thickness of the layers of insulation 14. The signal attenuation in the conductors is partly dependent upon the length of the conductors and also upon the distance between them. As a result, if over a unitary length of cable the twist lay of a certain pair is shorter than for other pairs, then each conductor length in this pair is longer than in the other pairs which would tend to increase the attenuation of the short twist lay pair. In addition, conductors of the pairs with short twist lay tend to be crushed closer together than other pairs with the result that the insulation is more compressed thereby bringing the conductors slightly closer together. This is also a factor in increasing the attenuation while at the same time lowering impedance. In fact, the impedance decreases rapidly from twisted pair to twisted pair as twist lay reduces. Also the attenuation increase caused by the closing together of the conductors and the longer length of conductors for shorter twist lays results in unacceptable attenuation values at high frequencies. This is exemplified as follows.

The attenuation is inversely proportional to the nominal characteristic impedance of each pair. The impedance is proportional to the square root of the inductance and inversely proportional to the square root of the capacitance. For normal considerations in telecommunications cable design, for normal voice frequency cables with a long twist lay, e.g. between 3.7 and 6 inches, the square roots of the inductance and capacitance change substantially proportionately from twisted pair to twisted pair having different twist lays. As a result of this, for normal voice frequency use cable designs the nominal characteristic impedance changes only slightly from pair to pair and is easily contained within the acceptable design limits of 100 ohms±15 ohms. However, when a telecommunications cable is designed to operate at high frequencies, perhaps up to 100 megabytes, it is desirable for this purpose to have each twisted pair with a relatively low twist lay, i.e. below 2 inches in length. Problems arise in this case with maintaining the nominal characteristic impedance within the desirable limits. One of the parameters for impedance, i.e. inductance, is proportional to the "physical spacing area" between the conductors of each pair, that is the distance between the conductors taken along the lengths of the conductors. In the example shown by FIG. 1, the physical spacing area is considered to be that area which is generated by a spatial distance line 16 extending between the conductors 12, the spatial distance line 16 being moved from end to end of the pair of conductors. The physical spacing area increases from pair to pair as the twist lay decreases while the length of each conductor also increases as the twist lay decreases. However, the capacitance depends primarily upon the helical length of each conductor. For high twist lay lengths of cable for voice frequencies, the change in the physical spacing area is substantially proportional to the change of helical length of the conductors for variation in twist lay and results in the substantially proportional change in inductance and capacitance discussed above which results in little or no change to impedance. However, when small twist lays are being considered, e.g. below 2 inches, this effects substantial increases in capacitance compared to increases in inductance. As a result of this, the impedance is known to decrease rapidly from twisted pair to twisted pair as twist lay reduces. If nominal characteristic impedance values are to be maintained within acceptable limits, this places a limit on the number of twisted pairs which may be placed in the core of a high frequency telecommunications cable having a large range of twist lays which are all below 2 inches. In addition, the change in nominal characteristic impedance has drastic effects upon the attenuation which reaches high attenuation levels which are also completely unacceptable.

The present invention provides a telecommunications cable structure which, as described in the following embodiment, enables the nominal characteristic impedance to be more closely controlled between its acceptable limits while also placing a control upon signal attenuation. It also enables telecommunications cable employing large numbers of pairs, i.e. twenty-five pairs or above, to be employed with a range of low twist lays while also avoiding the above-discussed problems.

Figure 2:
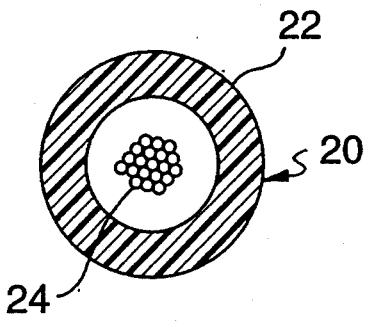
FIG. 2 is a cross-sectional view through a telecommunications cable for high frequency use and according to the embodiment.

As shown by the embodiment (FIGS. 2 and 3), a shieldless telecommunications cable 20 comprises a jacket 22 of any suitable material for inside building use, the jacket surrounding a cable core 24.

Figure 3:
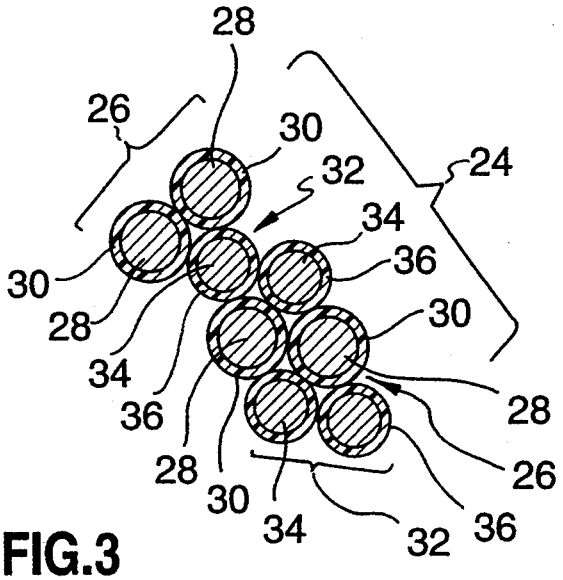
FIG. 3 is a cross-sectional view through part of a core of the cable of FIG. 2 and to a much larger scale.

The cable core 24 comprises twenty-five pairs of individually insulated conductors all of 24 AWG. Each pair has a different twist lay from all of the other pairs to minimize crosstalk. The lowest twist lay is 0.25 inches and the highest twist lay is 0.86 inches, the twist lays increasing incrementally between these two limits. As shown by FIG. 3, certain pairs 26 of the conductors have twist lays within a range of lower limits i.e. between 0.25 and 0.35 inches. There are ten of these conductor pairs with twist lays varying from 0.25 to 0.35 inches. Each of the conductors 28 in these pairs is individually insulated with a layer 30 of a chosen insulating material, the layer 30 having a thickness of 0.0095 inches to result in a total outside insulated diameter of 0.0391 inches. The other fifteen pairs 32 of conductors 34 having different twist lay lengths within a higher limiting range, each have an insulation layer 36 also of chosen insulating material, the insulation layer being 0.0085 inches in thickness to provide a total overall insulated thickness of 0.0361 inches.

With this construction as shown by the accompanying Table, the nominal characteristic impedance of each conductor pair lies within the limits which are acceptable in the telecommunications cable industry, i.e. 100 ohms±15 ohms. In addition, the attenuation as shown by the Table lies within acceptable limits. As may be seen from the accompanying Table, the ten twisted pairs within the lower range of twist lays, i.e. within 0.25 and 0.35 inches have a nominal characteristic impedances at 1 MHZ between 102.5 and 109.5 ohms and at 100 MHZ between 99.6 and 106.1 ohms. The fifteen twisted pairs lying within the upper twist lay range have nominal characteristic impedances which are comparable to those at the lower end of the range as may be seen from the Table.

As may be seen from the embodiment and from the accompanying Table, the nominal characteristic impedance may be controlled for twist lay lengths below 2 inches (and in this case below 0.86 inches) to enable a relatively large pair content cable to be made for use at high frequencies while producing acceptable nominal characteristic impedance and attenuation values. The embodiment as described uses twenty-five pairs all of which have acceptable values between the defined limits. As may be realized, the inventive concept may easily be used upon cables having more or lesser pairs than those described in the embodiment, any increase in limit differential between the lay lengths of extra pairs being easily accommodated by thicknesses of insulation which are different from those described in the embodiment and which are calculated to produce the desired nominal characteristic impedance and accompanying attenuation values.

In effect therefore, as may be seen from the above description and from the Table and also with particular reference to FIG. 1, for shorter twist lays, in which it is normally expected that the helical length of the conductor increases more rapidly than the physical spacing area, the thicker insulation provided upon the conductors of these pairs results in further spacing apart of the conductors. This effects an increase in the conductor length which is greater than increase in the physical spacing area so that the capacitance value increases more than the inductance value thereby controlling the nominal characteristic impedance values within the desirable limits. The change in insulation thickness therefore results in control of spacing between the conductors of the pairs dependent upon the twist lay lengths of the pairs so as to provide a balancing effect between capacitance and inductance to produce the desirable nominal characteristic impedance.

TABLE

| LAY | ATTENUATION 1 MHz (dB per 100 m) | ATTENUATION 100 MHz (dB per 100 m) | NOMINAL CHARACTERISTIC IMPEDANCE 1 MHz (ohm) | NOMINAL CHARACTERISTIC IMPEDANCE 100 MHz (ohm) | O.D. DIAMETER INCHES |
|---|---|---|---|---|---|
| 0.25 | 2.2 | 21.5 | 102.5 | 99.6 | 0.0391 |
| 0.26 | 2.1 | 20.7 | 105.7 | 101.8 | 0.0391 |
| 0.27 | 2.1 | 20.0 | 106.1 | 102.7 | 0.0391 |

TABLE-continued

| LAY | ATTENUATION 1 MHz (dB per 100 m) | ATTENUATION 100 MHz (dB per 100 m) | NOMINAL CHARACTERISTIC IMPEDANCE 1 MHz (ohm) | NOMINAL CHARACTERISTIC IMPEDANCE 100 MHz (ohm) | O.D. DIAMETER INCHES |
|---|---|---|---|---|---|
| 0.28 | 2.1 | 20.0 | 106.3 | 103.4 | 0.0391 |
| 0.29 | 2.0 | 19.8 | 106.4 | 103.9 | 0.0391 |
| 0.3 | 2.0 | 19.7 | 107.7 | 104.5 | 0.0391 |
| 0.31 | 2,0 | 19.2 | 108.2 | 105.0 | 0.0391 |
| 0.33 | 2.0 | 19.3 | 107.9 | 105.9 | 0.0391 |
| 0.34 | 2.0 | 19.2 | 108.6 | 106.6 | 0.0391 |
| 0.35 | 2.10 | 19.1 | 109.5 | 1.06.1 | 0.0391 |
| 0.36 | 2.1 | 20.8 | 103.2 | 98.4 | 0.0361 |
| 0.38 | 2.1 | 20.4 | 103.0 | 98.8 | 0.0361 |
| 0.41 | 2.0 | 20.0 | 104.8 | 101.1 | 0.0361 |
| 0.44 | 2.0 | 20.0 | 105.0 | 100.0 | 0.0361 |
| 0.46 | 2.0 | 20.0 | 104.6 | 102.5 | 0.0361 |
| 0.48 | 2.0 | 19.5 | 105.0 | 101.4 | 0.0361 |
| 0.52 | 1.8 | 18.8 | 107.9 | 103.6 | 0.0361 |
| 0.53 | 2.0 | 19.9 | 106.1 | 100.7 | 0.0361 |
| 0.58 | 2.0 | 19.5 | 107.1 | 102.1 | 0.0361 |
| 0.64 | 2.0 | 19.7 | 106.4 | 102.5 | 0.0361 |
| 0.66 | 1.8 | 18.8 | 108.2 | 99.1 | 0.0361 |
| 0.71 | 1.8 | 19.5 | 106.3 | 100.9 | 0.0361 |
| 0.75 | 1.8 | 19.5 | 107.1 | 102.9 | 0.0361 |
| 0.8 | 1.8 | 19.2 | 108.4 | 101.6 | 0.0361 |
| 0.86 | 1.8 | 18.7 | 108.2 | 100.7 | 0.0361 |

What is claimed is:

1. A telecommunications cable comprising a core having a plurality of pairs of twisted together individually insulated conductors with all of the conductors being of the same gauge and the maximum twist lay of the plurality of pairs being 2.00 inches with a first group of the plurality of conductor pairs having twist lays within a first range, the conductors of the first group having the same insulation thickness which is consistent with providing a nominal characteristic impedance for each conductor pair of the first group within desirable limits and an acceptable signal attenuation, and at least a second group of the plurality of conductor pairs having twist lays within a second range, the conductors of the second group having the same insulation thickness which is different from that for the first group and which is consistent with providing a nominal characteristic impedance for each conductor pair of the second group which is also within the desirable limits and an acceptable signal attenuation.

2. A telecommunications cable according to claim 1 wherein the twist lay of each conductor pair is different from each other pair.

3. A telecommunications cable according to claim 1 wherein there are twenty-five conductor pairs including two groups of conductor pairs in each of which the conductor insulations are of substantially equal thickness, the thickness being different from one group to the other.

4. A telecommunications cable according to claim 1 wherein the conductors are each of 24 AWG and have different twist lays from 0.25 to 0.86 inches with the conductors in a plurality of conductor pairs with twist lays within a lower range each having an insulation thickness which is greater than an insulation thickness of the other conductor pairs with twist lays within an upper range.

5. A telecommunications cable according to claim 4 wherein each conductor of a pair within the lower range of twist lays has an insulation thickness of 0.0095 inches, the lower range being from 0.25 to 0.35 inches, and each conductor of a pair within the upper range of twist lays has an insulation thickness of 0.0085 inches.

* * * * *

US005424491C1

(12) EX PARTE REEXAMINATION CERTIFICATE (9712th)

United States Patent
Walling et al.

(10) Number: US 5,424,491 C1
(45) Certificate Issued: Jun. 25, 2013

(54) TELECOMMUNICATIONS CABLE

(75) Inventors: Jorg-Hein Walling, Beaconsfield (CA); Glement Gagnon, Pierrefonds (CA); Paul P. Kish, St. Lazare (CA); Martin L. Belanger, Montreal (CA)

(73) Assignee: Belden Inc., St. Louis, MO (US)

Reexamination Request:
No. 90/009,467, Jun. 29, 2009

Reexamination Certificate for:

| | |
|---|---|
| Patent No.: | **5,424,491** |
| Issued: | **Jun. 13, 1995** |
| Appl. No.: | **08/133,392** |
| Filed: | **Oct. 8, 1993** |

(51) Int. Cl.
*H01B 11/04* (2006.01)

(52) U.S. Cl.
USPC ..... 174/113 R; 174/34

(58) Field of Classification Search
None
See application file for complete search history.

(56) References Cited

To view the complete listing of prior art documents cited during the proceeding for Reexamination Control Number 90/009,467, please refer to the USPTO's public Patent Application Information Retrieval (PAIR) system under the Display References tab.

*Primary Examiner* — Minh Nguyen

(57) ABSTRACT

High frequency cable with short twist lays with the insulation thickness of conductors being different from that of others, the thickness of insulation being dependent upon twist lay length so as to achieve a desired characteristic impedance and signal attenuation.

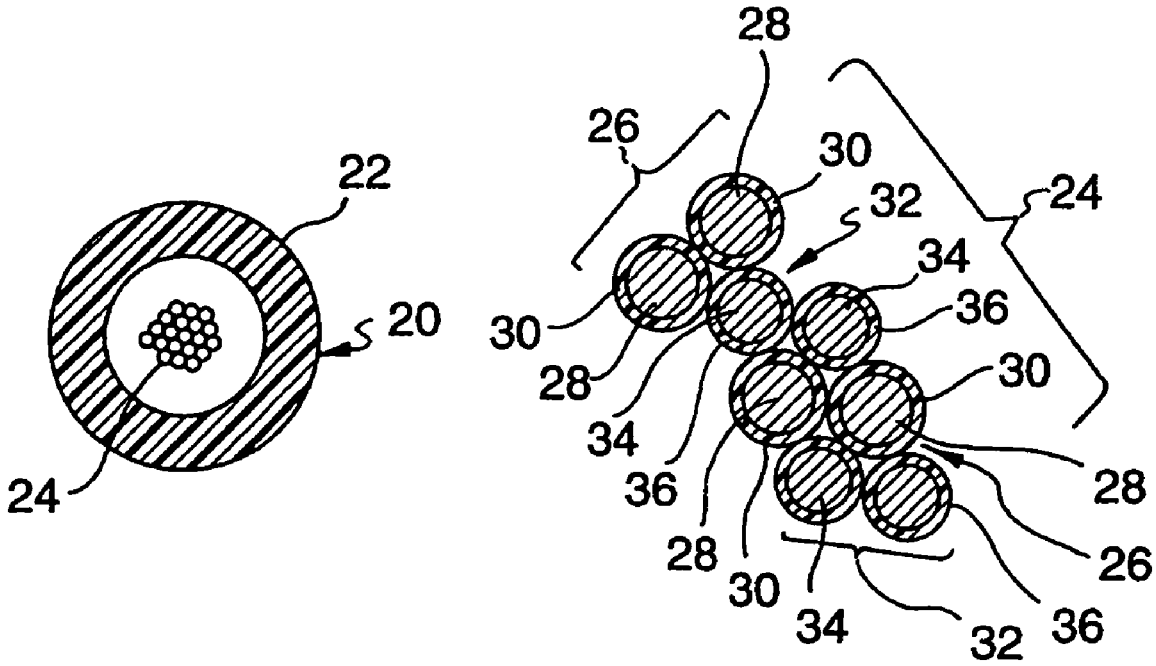

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-5 are cancelled.

* * * * *